United States Patent [19]

Ballyns

[11] Patent Number: 4,910,985

[45] Date of Patent: Mar. 27, 1990

[54] METHOD AND APPARATUS FOR THE DETECTION AND CORRECTION OF ROLL ECCENTRICITY IN ROLLING MILLS

[75] Inventor: Jacobus Ballyns, Oswego, N.Y.

[73] Assignee: Alcan International Limited, Kingston, Canada

[21] Appl. No.: 70,298

[22] Filed: Jul. 6, 1987

[30] Foreign Application Priority Data

Jul. 9, 1986 [CA] Canada ..... 513417

[51] Int. Cl.[4] ..... B21B 37/08

[52] U.S. Cl. ..... 72/8; 72/11; 72/16; 72/21; 364/472

[58] Field of Search ..... 72/8, 10, 11, 16, 17, 72/19, 20, 21; 364/472

[56] References Cited

U.S. PATENT DOCUMENTS

| | | | |
|---|---|---|---|
| 3,312,091 | 4/1967 | Kobayashi | 72/11 |
| 3,709,009 | 1/1973 | Shiozaki et al. | 72/8 |
| 3,795,124 | 3/1974 | Diolot | 72/20 |
| 3,920,968 | 11/1975 | Imai et al. | 72/8 |
| 3,928,994 | 12/1975 | Ichiryu et al. | 72/8 |
| 4,036,041 | 7/1977 | Ichiryu et al. | 72/8 |
| 4,038,848 | 8/1977 | Ichiryu et al. | 72/8 |
| 4,299,104 | 11/1981 | Hayama et al. | 72/20 |
| 4,648,257 | 3/1987 | Oliver et al. | 72/16 |
| 4,656,854 | 4/1987 | Stewart et al. | 72/8 |
| 4,685,063 | 8/1987 | Weihrich et al. | 72/16 X |

FOREIGN PATENT DOCUMENTS

| | | |
|---|---|---|
| 58-199615 | 11/1983 | Japan . |
| 2145250 | 3/1985 | United Kingdom . |

*Primary Examiner*—W. Donald Bray
*Attorney, Agent, or Firm*—Cooper & Dunham

[57] ABSTRACT

The invention provides a new apparatus for the detection, measurement and display of roll and roll bearing eccentricity in a rolling mill, and also an apparatus for correction of such eccentricities. The apparatus comprises individual narrow band-pass filter modules, each dedicated to the detection and development of a signal corresponding to one eccentricity, such as fundamental back-up roll eccentricity, fundamental work roll eccentricity and fundamental bearing eccentricity, or any individual harmonics of the fundamentals that are of sufficient value to merit display and corrective action. The resultant signals from the different modules are summed and applied to a display, or employed to take corrective action. Such dedicated modules can be made relatively cheaply and are stable requiring little maintenance, as compared to the more complex equipment proposed hitherto, requiring shaft encoders and/or high speed computers. Preferably each filter module comprises a first frequency controllable phase locked narrow band filter which removes as much as possible of the extraneous "noise" of the rolling pressure signal, and a second matched filter which is able to operate rapidly with the cleaner signal provided to it by the first filter.

29 Claims, 8 Drawing Sheets

METHOD AND APPARATUS FOR THE DETECTION AND CORRECTION OF ROLL ECCENTRICITY IN ROLLING MILLS

FIELD OF THE INVENTION

The present invention is concerned with improvements in or relating to methods and apparatus for the detection and correction of roll eccentricity in rolling mills.

REVIEW OF THE PRIOR ART

The term "eccentricity" as applied to the rolls of a rolling mill strictly should only be used to refer to a lack of concentricity between a roll bearing centre and the centre about which the roll has been ground, but it is regularly colloquially used in the industry to include all possible aspects of out-of-roundness, such as ovality of the roll, and changes in its shape that occur because of temperature changes during rolling periods, and cooling during the interim non-rolling periods, and it is this broader meaning that is embraced by the term as used herein.

It is now standard to employ with a rolling mill some form of automatic gauge control including a detector or detectors which measure the rolling force, and roll gap actuators which change the roll gap in accordance with the measurement to maintain the output gauge as constant as possible. However, roll eccentricity is one parameter that causes the automatic control to operate in the wrong direction; thus, an increase in pressure measured as the roll gap is reduced by roll eccentricity is not distinguished by the control from one caused by an increase in the input gauge, so that it decreases the roll gap at a time when an increase is required instead, and vice versa.

The effect of such eccentricity is therefore that a more-or-less regular reoccurring variation in thickness is imprinted on the material being rolled, and such imprinted variation must be minimized as far as that is economically possible. It is found, for example, that customers are becoming progressively more demanding in their requirements for gauge that is as constant as possible within predetermined limits, so that they can in turn reduce the thickness of material they employ without the problems caused by under- or over-gauge. For many products the control of the final gauge and the extent of the variations therefrom is highly critical, and a particular example is can stock, namely thin sheet that is deep drawn to make cans for the packaging of pressurised liquids, such as beer and soft drinks, and with this product the maximum permissible gauge variation is ±2.0% and more usually ±1.5%.

It is known that roll eccentricity in the broader sense defined herein is a major contributor to gauge variation in the finished product, other contributors being, for example, the capabilities of the automatic gauge control system and the tension regulator employed, the effectiveness of the lubrication system and the lubricant employed, and the existing variation in gauge of the material as it enters the stand. In practice it is usually found that the eccentricity of the back-up rolls is the major component of the total "stack eccentricity". The eccentricity contribution should of course be held as low as possible by careful attention to the roll grinding and mill operating practices, but it is still found that it can comprise as much as 10–30% of the gauge spread observed after a single pass through the mill stand.

One standard procedure for monitoring roll eccentricity is to carry out periodic "kiss" pass tests, in which the rotating work rolls are engaged together under a normal light rolling load without work between them while the load between them is measured, the variations observed being predominantly due to the eccentricity. Such tests of course require the mill to be "shut down" with loss of production and show only the eccentricity which originates in the grinding practice. Unfortunately, during rolling the eccentricity does not remain constant owing, for example, to thermal changes in the work rolls, roll sag and thermal gradients, particularly in the back-up rolls, and these other factors can in practice be as large or larger than those due to the above-mentioned lack of roll concentricity. Moreover, owing to their periodic nature, they are not able to give the operator an accurate picture of the rolling conditions that actually exist, and this is the on-going information needed by the operator to produce a product with gauge consistently within the required tolerances.

The basic problem has of course long been recognized in the industry and a number of methods and systems have been proposed for its solution. Many of these systems require the use of angular position transducers which rotate with the rolls and provide synchronous position signals which enable the correcting signal to be accurately phased with the eccentricity. Examples of such systems are disclosed in U.S. Pat. Nos. 3,881,335, 3,882,705, 3,893,317, 4,126,027 and 4,299,104. These systems, and particularly the transducers which they employ, are relatively expensive and provide an on-going maintenance problem because of the hostile environment in which they must operate. Other systems require high performance computers employing high speed Fourier transforms or statistically-based algorithms to compute and cancel out the frequencies related to the rolls, and examples of such systems are disclosed in U.S. Pat. Nos. 3,889,504, 3,920,968, 4,222,254 and 4,531,392. Such systems are complex and expensive to implement and involve special programming and start-up practices, especially after a roll change or power failure.

Moreover, the complex equipment employed requires skilled set-up and maintenance personnel, who must be available immediately or at very short notice on a 24 hour basis to meet the special requirements of the rolling industry for continuity of operation. This may become such a problem that eventually the operators prefer to run without the system entirely, so as to give consistent operating conditions.

DEFINITION OF THE INVENTION

In order to attain the desired lower tolerance product, there is a need for a relatively simple robust meter that will provide a constant review of the eccentricity of the mill stand, and particularly the back-up roll eccentricity, so that corrective action can be taken in good time.

There is a corresponding need for a relatively simple and inexpensive correction system that will permit reduction in gauge variation caused by roll eccentricity.

In accordance with the present invention there is provided apparatus for the detection, measurement and display of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be detected, measured and displayed;

means feeding the said pressure electric signal to a narrow band-pass filter of band-pass characteristic such as to pass a signal variation of the frequency of the roll eccentricity;

means feeding the speed electric signal to the band-pass filter to vary the filter band-pass characteristic in accordance with the roll speed;

means receiving the filtered signal and producing therefrom a display electric signal; and means applying the said display electric signal to a visual display means for viewing by an operator to show the magnitude of the roll eccentricity.

Also in accordance with the invention there is provided apparatus for the detection and correction of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be corrected;

means feeding the said pressure electric signal to a narrow band-pass filter of band-pass characteristic such as to pass a signal variation of the frequency of the roll eccentricity;

means feeding the speed electric signal to the band-pass filter to vary the filter band-pass characteristic in accordance with the roll speed;

means receiving the filtered signal, producing therefrom the said electric correction signal and applying it to the roll pressure varying means to at least partially correct for the roll eccentricity.

DESCRIPTION OF THE DRAWINGS

Embodiments of the invention will now be described by way of example, with reference to the accompanying drawings, wherein.

DESCRIPTION OF THE PREFERRED EMBODIMENTS

The apparatus of the invention takes a new approach to the problem of the detection, measurement, display and subsequent correction of rolling of mill stand eccentricity by providing a relatively simple, robust and inherently readily maintained detection circuit that, without the use of angular position transducers or their equivalent on the rolls, and without the use of powerful, high speed computers, can provide a display or correction signal of one of the eccentricities that has effectively been isolated from the many that are present. Such a circuit is relatively low in cost to the extent that it can readily be multiplicated, with each additional circuit dedicated to the provision of a signal for a respective eccentricity component or its harmonic. The outputs of all the circuits can be employed in parallel for appropriate display and/or correction, a respective dedicated circuit of course only being provided for an eccentricity of sufficient magnitude to justify an attempt at display and/or correction in this manner.

The gauge variation caused by back-up roll eccentricity is typically relatively smoothly sinusoidal in nature with a cycle dependent on the roll diameter. The two rolls are usually always of slightly different diameters, and the difference can vary as they are ground in use until they are discarded. Because of this difference there will be a maximum effect from their addition when they are in phase, and a minimum when they are of opposite phase and oppose one another; the resultant eccentricity therefore occurs at a "beat" frequency which increases as the difference in diameters increases. Eccentricity in the work rolls will produce similar, but usually smaller, effects at higher frequencies because of their smaller diameters. It is also found upon careful investigation that the rolled strip frequently contains small gauge changes (e.g. 0.005 mm to 0.010 mm in a strip of 0.3 mm) that are short in length (25–300 mm) and apparently are caused by anomalies in the surfaces of the back-up or work rolls such as "flats", and/or by mill resonance, occurring at intervals corresponding to the diameter of the respective roll.

Figure 1:
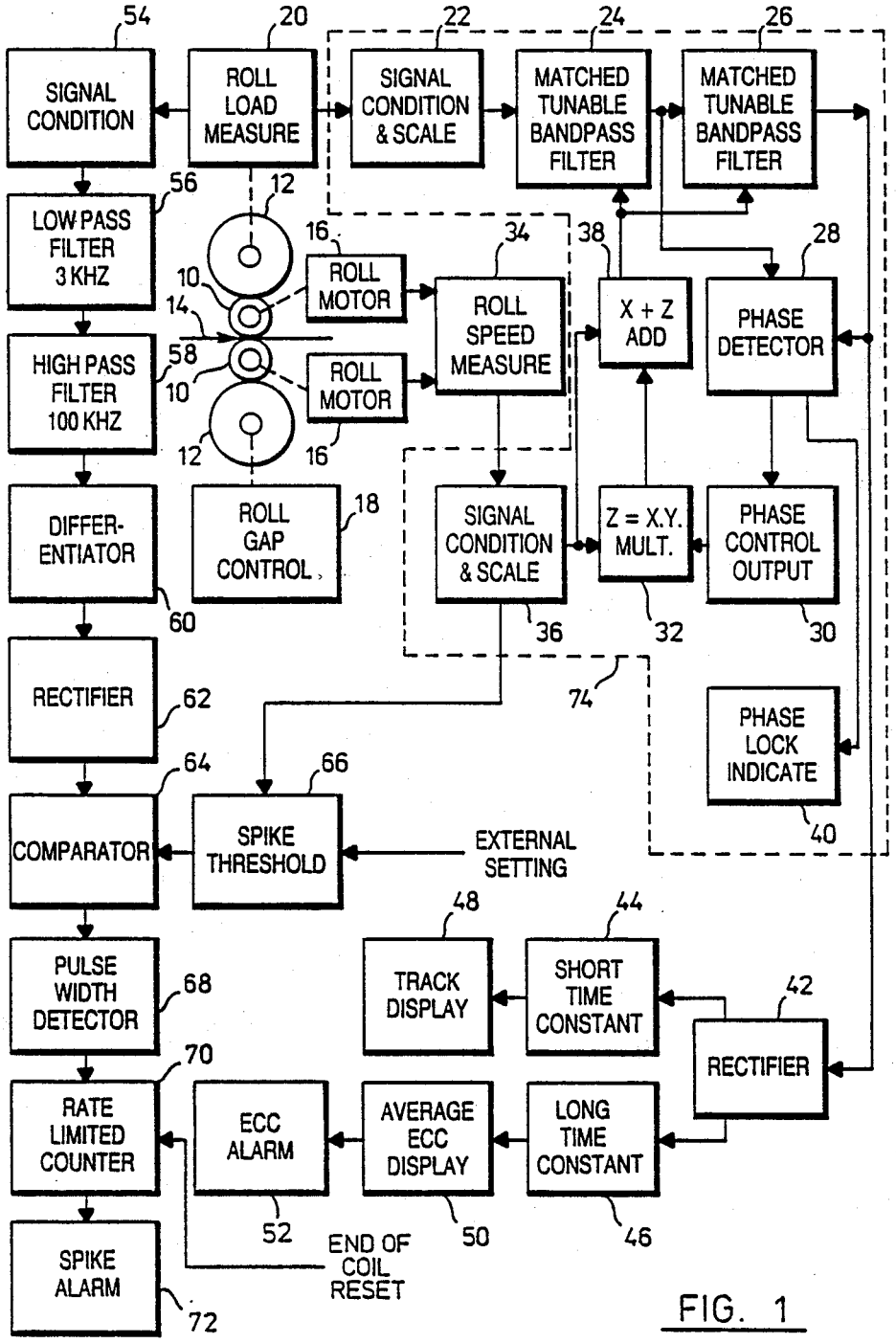
FIG. 1 is a schematic representation of a single eccentricity rolling meter of the invention.

Referring now to FIG. 1, a typical four high rolling mill stand is illustrated schematically, and may be a single stand, or one of the stands of a multi-stand mill. Each stand comprises two work rolls 10 and respective back-up rolls 12, the mill stand being operative to process a work piece 14 such as thin aluminum or steel sheet whose gauge is to be reduced. The two work rolls are driven by respective roll motors 16 and the opening between the two rolls is controlled by a roll gap control 18, which usually comprises a pair of hydraulic load cylinders, one at each side of the roll and applying roll force to the bearing chocks and thus to the back-up roll through to the work rolls. A roll load measuring system 20 is connected to the roll stack and measures the roll load applied to the strip 14, producing a corresponding roll load electric signal. One common means for producing such a signal is to connect the roll load measuring system to the roll gap control cylinders so that it measures the hydraulic pressure therein continuously and rapidly, the resultant pressure electric signal representing the on-going magnitude of the roll load. The signal from the measuring system 20 is conditioned by a circuit 22 which removes the D.C. component, and scales it to ensure that it is of suitable amplitude to be fed to the remainder of the circuit. The output from circuit 22 is fed to two matched tunable narrow band-pass filters 24 and 26 in series, both of which are fed with a speed electric signal representative of the speed of the roll whose eccentricity is to be determined, measured and displayed.

In this embodiment the speed electric signal is obtained from the roll motors even when, as is more usually the case, it is the eccentricity of a back-up roll that is under investigation. Thus, the back-up rolls are driven by the work rolls and, in view of the high contact pressure between them, the frequency of rotation of the back-up roll is quite accurately a function of the motor speed multiplied by the ratio of the work roll diameter to the back-up roll diameter. The circuit to be described is employed for the measurement, display, etc. of the fundamental back-up roll eccentricity, and in the preferred embodiment separate respective parallel circuits are employed for the two sides of the roll stack, since in practice it is found that the values obtained can be substantially different between the operator side and the drive side; for simplicity of illustration only one of the circuits is shown and described. The two filters are of the type in which the centre frequency of the pass band is adjusted automatically within a predetermined range in accordance with the value of the speed signal, while retaining a substantially constant pass band. It must also be possible to lock the phase of the output signal to that of the input signal, so that the filter will remain with its operative centre frequency at the eccentricity frequency, and this is done by a respective phase lock loop for each filter. The pass band width that is required for each filter is determined by the need to pass signals corresponding to the eccentricity of the back-up rolls as they vary in diameter from the largest that can be used in the mill, down to the smallest that is employed before the roll is finally discarded, so that once the circuit has been installed it does not require adjustment to compensate for such roll changes. The filter band must also be sufficiently narrow that it will reject other sources of load variation, such as eccentricity in the bearings and the work rolls, spikes and harmonics of the original signal.

The signal supplied to the filter 24 is noisy and highly complex in character containing components representing the back-up roll, work roll and bearing fundamental eccentricities, plus their harmonics, which can be as substantial as the fundamentals, together with entry gauge variations. Any attempt to phase lock such a signal would require an inordinately long time constant, perhaps of the order of 20–30 minutes, which is impractical for a rolling mill. However, the output signal from the first filter 24 is relatively "clean" and upon its application to the second filter 26 it is found that the required phase locking can be obtained within a reasonable period of time, e.g. say 20–30 seconds from start-up. This period can be reduced substantially for subsequent operations using the information from previous rolls.

Figure 2:
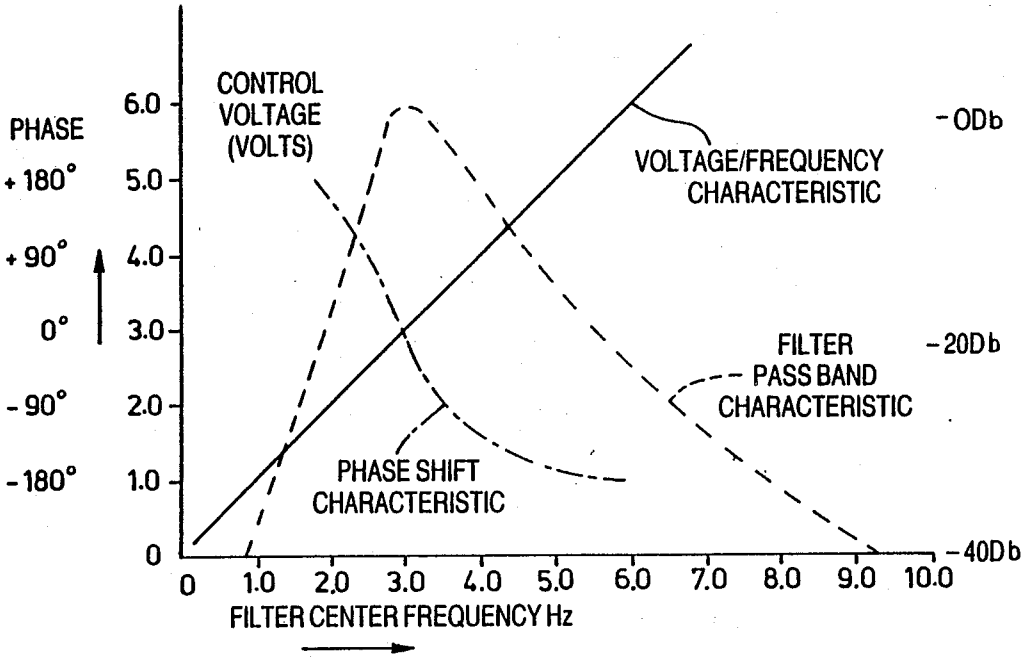
FIG. 2 is a representation of the voltage/frequency; pass band and phase shift characteristics of a filter circuit employed in the invention.

The response characteristic of either of the filters 24 or 26 is illustrated in FIG. 2. For a four high rolling mill operating at speeds in the range 500–1,200 m/m, employing back-up rolls of about 125–135 cm diameter a suitable centre frequency is 3 Hz with a band-pass of 0–6 Hz, each filter having a Q factor in the range 2–10 and preferably about 3. The particular matching that is required for the two characteristics is that with an input signal of the same frequency and a control signal of the same value (which correspond to the input signal frequency) they must both produce zero phase shift. It is now not necessary to measure accurately the frequency of the eccentricity variation, since the phase-locked controllable filters will adjust the centre pass frequency automatically to this value and maximize the corresponding output signal. Suitable filters are type APV13P sold by A.P. Circuit Corp. of New York, N.Y.

The outputs from the two filters are fed to a phase detector 28, which produces output signals that are fed to a phase control output circuit 30 that produces control voltages of the kind required by the filters for their control as described above. The signals Y from phase control 30 proportional to the phase error are fed to a multiplier circuit 32, while the roll motor speeds are supplied to a roll speed measuring circuit 34 that produces a voltage representative of those speeds. The output from circuit 34 is supplied to a conditioning and scaling circuit 36 to provide a signal X that corresponds to the particular frequency for the roll under investigation. For example, since the motors 16 rotate at the speed of the work rolls 10, the signal must be scaled down in frequency to be representative of the larger diameter back-up rolls 12. The signal X is fed to an add circuit 38 in which there is added to it the signal Z (=X.Y), this signal Z being limited to a fraction of the signal X (e.g. about 10%) so that the speed signal predominates at all times and the phase locking signal cannot over-ride it. The outputs from the add circuit 38 are fed to the respective filters to control them as described.

The phase control circuit 30 also includes "seize and hold" circuits that will retain in memory the average control voltages employed in the rolling of a strip or coil, so that this information is available for the next strip or coil, so as to avoid the long start-up period otherwise required for phase synchronization when starting from zero. An output signal from the phase detector 28 goes to a phase lock indicator 40 that will indicate to the operator that phase lock has occurred.

The signal from the second filter 26 is also passed to a rectifier 42, the two outputs of which constitute respective display electric signals and are fed through respective time constant circuits 44 and 46 to two respective display means 48 and 50. The circuit 44 has a short time constant, for example about 3.3 seconds, so that its response is fast enough for it to be able to track for display on the display means 48 not only the back-up roll eccentricity, but any beat phenomena which occurs between the two back-up rolls. The circuit 46 has a long time constant, for example about 50 seconds, so that the display means 50 shows a "pseudo average" of the variation in rolling load force due to eccentricity in the back-up roll. This latter display means can be provided with a sample and hold circuit, so that its output shows the average back-up roll eccentricity level of the coil that has been rolled. The display means 50 also outputs to an eccentricity alarm 52 that will give audible and/or visible warning to the operator when the eccentricity exceeds a predetermined value.

The device is also provided with a load spike detecting system including a signal conditioning circuit 54 connected directly to the roll load measuring circuit 20 which feeds the received signal through successive low and high pass filters 56 and 58 to remove unwanted signals as much as possible. The filtered signal is differentiated at 60 and the differentiated signal fed via a rectifier 62 to a comparator 64. The comparator is also supplied with a roll speed signal that has been conditioned by the circuit 36 and is fed via a spike threshold control circuit 66, so that the level at which spikes are acknowledged or not by the comparator is set in accordance with mill speed; the circuit 66 can also be set externally by the operator. The output of the comparator is fed to a pulse width detector 68 and then to a rate limited counter 70 that is reset at the end of each coil. If greater than a predetermined number of spikes are counted by the counter 70 during the rolling of a roll, then the spike alarm 72 is actuated. The device therefore provides the operator with a constant indication of the roll stack quality of the mill stand with respect to the roundness of the rolls while rolling metal, and also will alarm him of abnormal conditions.

Figure 3:
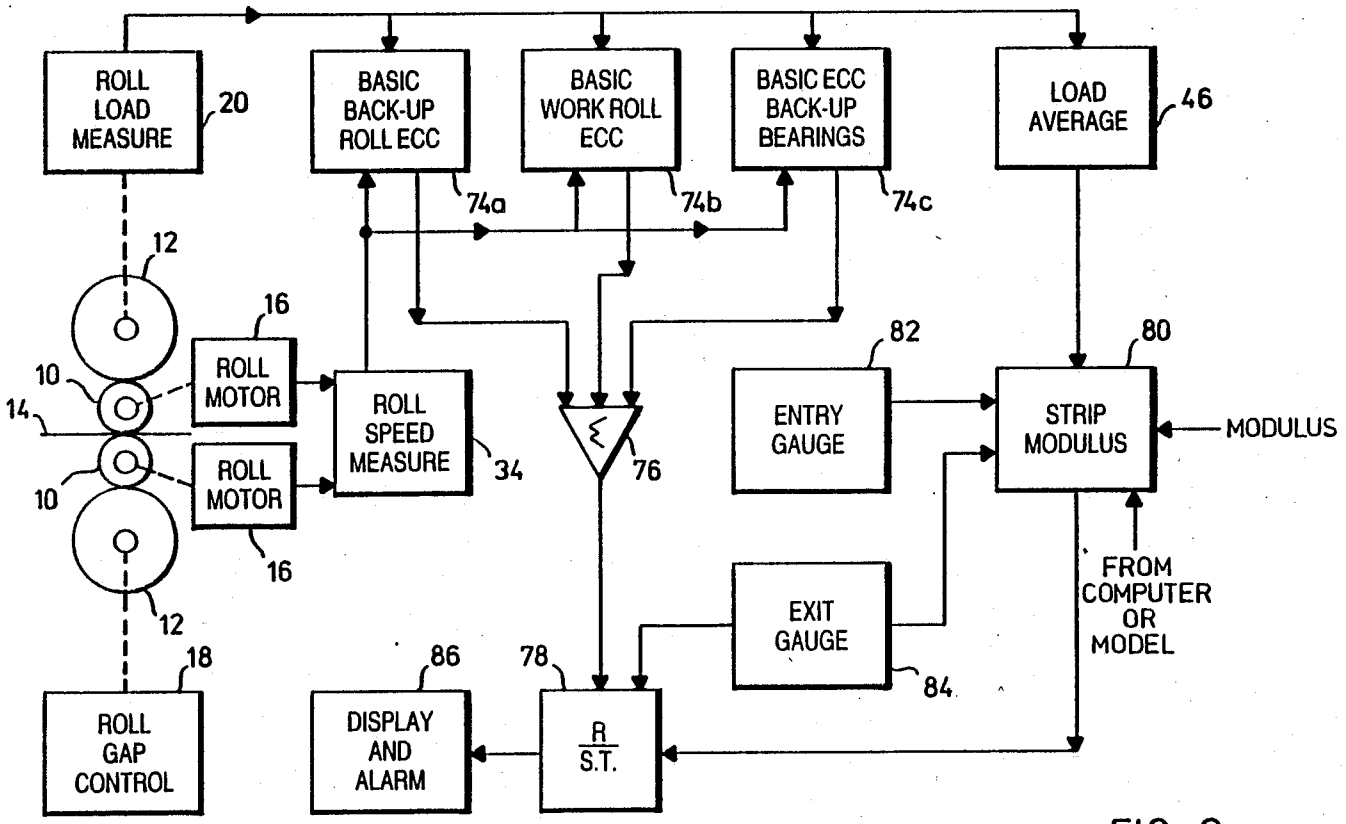
FIG. 3 is a schematic representation of a multiple eccentricity meter of the invention.

A development of the invention is shown in FIG. 3, in which the same reference numbers are used for corresponding parts, all of the circuit elements within the broken line 74 in FIG. 1 being shown in FIG. 2 as a single equivalent block 74 with a respective subscript a, b, c, etc. Thus, in this circuit the signal from the measuring circuit 20 is supplied to a back-up roll basic or fundamental eccentricity circuit 74*a*, a work roll basic or fundamental eccentricity circuit 74*b* and a back-up bearing basic or fundamental circuit 74*c*, all of which are also supplied with a speed signal obtained from the roll speed measure circuit 34. Additional circuits 74 can be provided for any harmonic of the basic eccentricities that are of sufficient magnitude to justify correction, and for any other eccentricity component found in the signal from measuring circuit 20. The outputs of these circuits are summed in a summing circuit 76, the output of which is fed as a signal R to a ratio circuit 78. A long time constant load averaging circuit 46 supplies a signal to a register 80 containing information as to the modulus of the strip being rolled, which is obtained from a computer memory store or model, or may be computed from the entry and exit gauges obtained respectively from gauge measurers 82 and 84. The resulting signal S is fed to the ratio circuit 78 together with signal T from the exit gauge measure. The output comprising the result of the computation R/S.T is supplied to a display and alarm circuit 86. This output represents the gauge deviation as a percentage of the nominal gauge solely due to roll stack eccentricity, the eccentricity components being summed and expressed as a percentage of the nominal exit gauge. The display circuit is set so that if this ratio rises to above an unacceptable value, e.g. 1.5% or 2%, the display 86 sounds and the mill operator is alarmed. Additional displays can of course be provided to show the component of the rolling load variation due to work roll eccentricity and roll bearing eccentricity, and with all of the meters these levels can be displayed in both tons and as a percentage of the change in gauge.

It is universal practice in rolling mills that two roll gap regulators, or equivalent mechanical screw-down devices, are provided one at each side of the roll, which usually are referred to as respectively the drive side and operator side. It has been found as mentioned above that the eccentricities as measured at the two different sides are not the same and owing to the relatively low cost and simplicity of the circuits of the invention it may be preferred to provide separate indications for the drive side and operator side, in which case all that is required with the embodiments of FIGS. 1 and 3 is to duplicate the circuits and provide separate displays.

Figure 4:
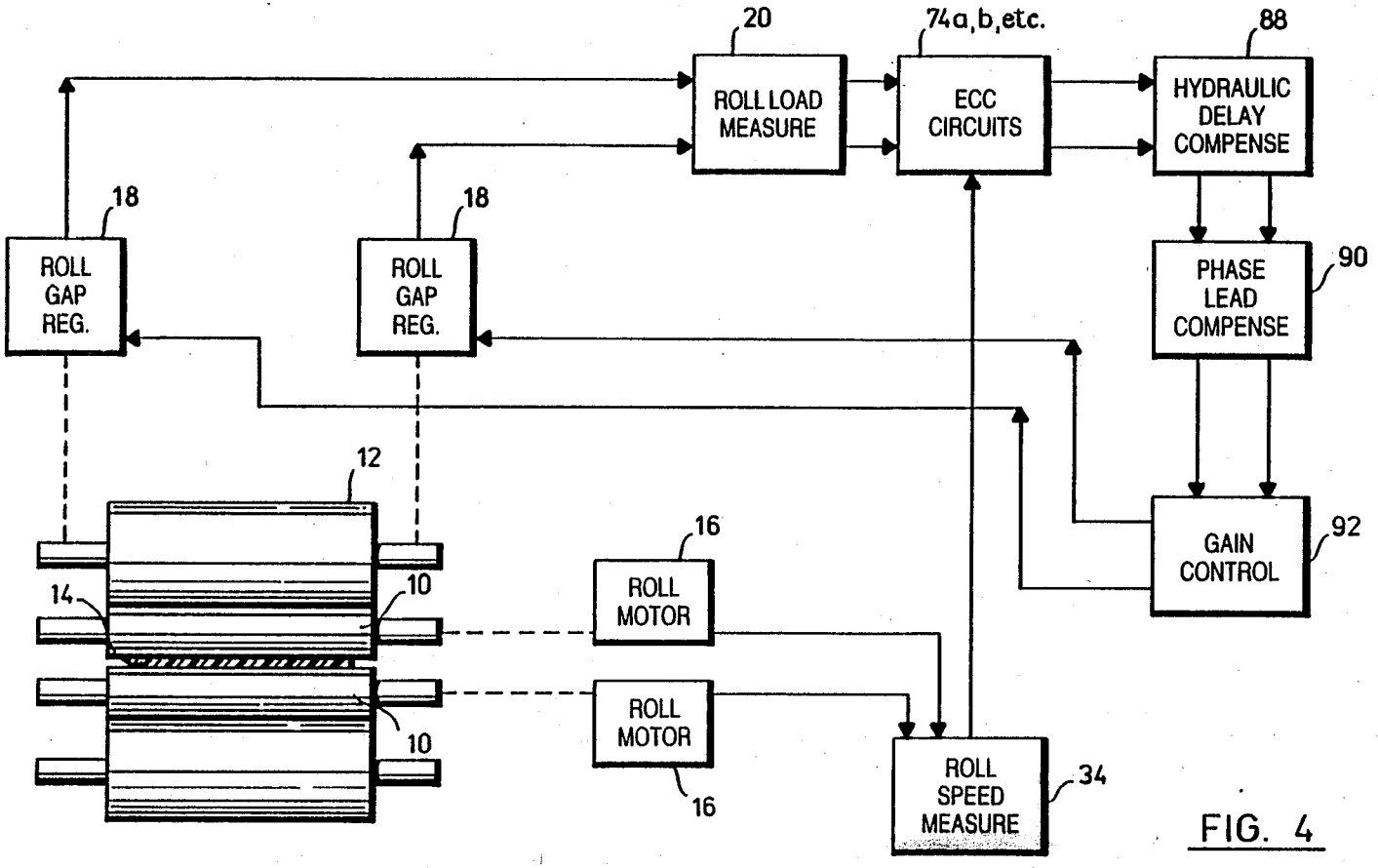
FIG. 4 is a schematic representation of a rolling mill eccentricity cancellation system of the invention.

The inventive concept may also be embodied into a roll eccentricity cancellation controller system, and such a system is illustrated schematically in FIG. 4, the same reference numbers being employed where possible. In the system illustrated advantage is taken of the provision of separate roll gap regulators to provide separate compensation therefor, instead of averaging as with the embodiments of FIGS. 1 and 3. Thus, the roll loads as measured at the roll gap regulators are measured separately, and the resulting signals are forwarded to respective eccentricity measuring circuits 74*a*, 74*b*, etc., all of which are controlled by the average speed signal obtained from the roll motors. An average speed signal will usually be employed, although in practice the two roll motors may sometimes be driven at slightly different speeds in order to prevent curling of the strip. The respective signals are fed to a hydraulic delay compensating circuit 88 which is arranged to compensate for the delay inevitably introduced by the physical distance between the hydraulic fluid in the roll gap regulator and the transducer by which the roll load is actually measured by measurement of the hydraulic fluid pressure; in practice this distance is of course made as short as possible. Alternatively the phase change can be introduced in the filter phase lock circuits. The signals from compensator 88 are fed to a phase lead compensating circuit 90, which will provide the necessary compensation for the overall phase differences imposed by the remainder of the system and ensure that the control signals produced by gain control circuit 92 and fed to the roll gap regulators 18 are accurately in the required phase to compensate and cancel out as far as possible the determined eccentricity component of the signals as measured by the roll load measuring circuit 20. The system is therefore a truly closed loop system. It is of course not necessary to provide separate compensation in the manner indicated, and instead the roll load measuring signal can be averaged and subsequently fed through a circuit 74, hydraulic delay compensator 88, phase lead compensator 90 and gain control 92.

In one process for the production of thin aluminum sheet, aluminum is cast or hot rolled to a thickness of between 2 mm (½") and 25 mm (1") and is reduced while hot in a four high hot mill with about three to five passes to a product of approximately 3–4 mm thick. This material subsequently is reduced to can stock of approximately 0.3 mm thickness with a maximum gauge variation of ±0.005 mm, equivalent to about ±1.5% of overall thickness. Such accurate gauge control is not difficult to attain at thicknesses of 0.75 mm and above, but becomes progressively more and more difficult below that value. A typical four high mill for rolling such thin material will have work rolls of approximately 50–55 cm diameter and back-up rolls of approximately 125–135 cm diameter.

Figures 5A, 5B, 5C:
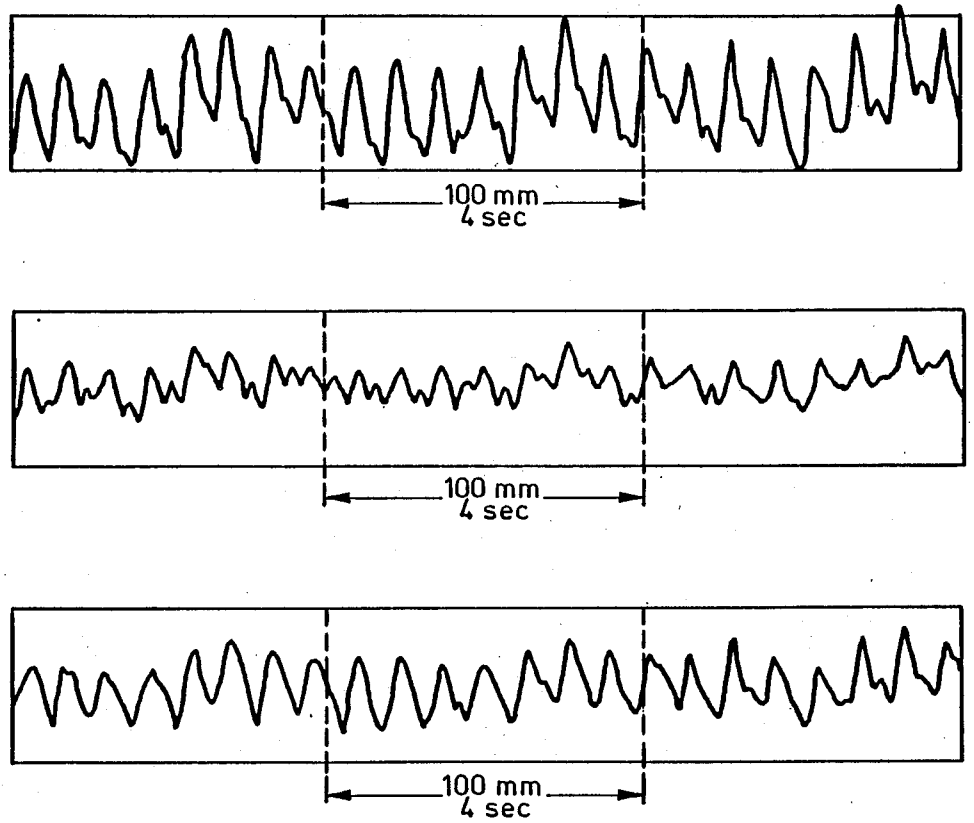
FIGS. 5*a* to 5*c* are traces developed on a recording meter of the rolling load observed in a mill stand, FIG. 5*a* showing the overall load, FIG. 5*b* that on the mill drive side, and FIG. 5*c* that on the mill operator side.

FIGS. 5*a* to 5*c* show the rolling load traces obtained using a 5 Hz band-pass filter, the trace 5*a* being the average between the two sides, so that the nominal rolling load is the total load of the stand, namely 800 tons; FIG. 5*b* shows the corresponding trace for the drive side and FIG. 5*c* shows the corresponding trace for the operator side, both of these operating with a nominal rolling load of 400 tons each.

Figure 6A:
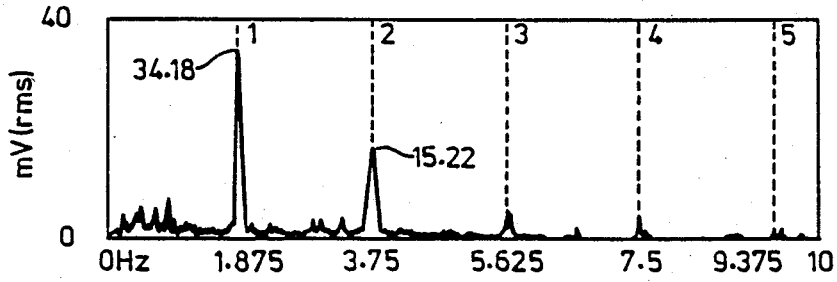
FIGS. 6*a* to 6*c* are traces of the rolling load frequency spectra, respectively overall, on the drive and operator sides, showing the frequencies at which the back-up roll fundamental and its harmonics occur.
Figure 6B:
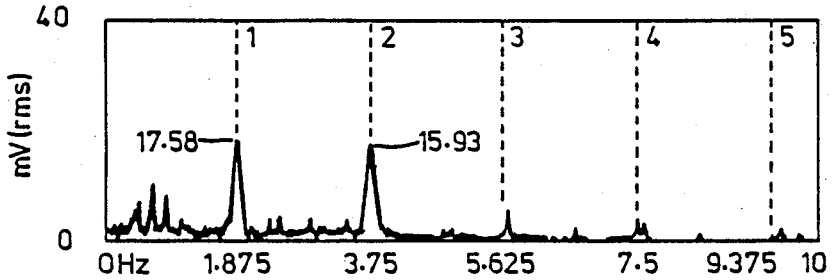
Figure 6C:
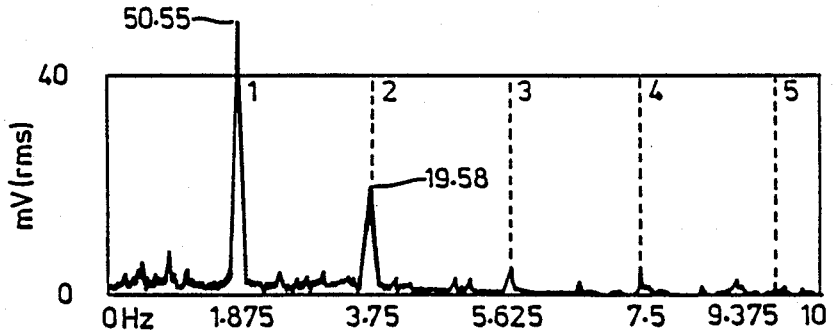
Figure 7A:
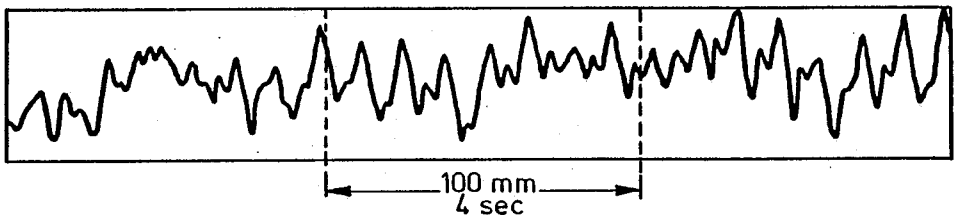
FIGS. 7*a* to 7*c* are traces similar to FIGS. 5*a* to 5*c* respectively, showing the effect of the operation of the eccentricity correction system of the invention.
Figure 7B:
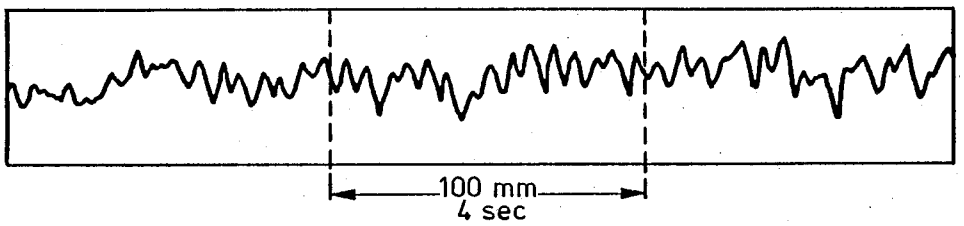
Figure 7C:
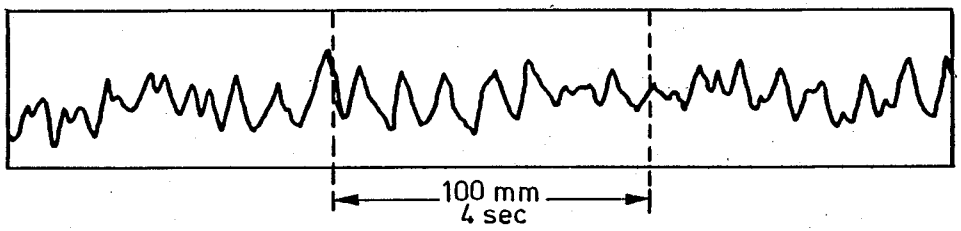
Figure 8A:
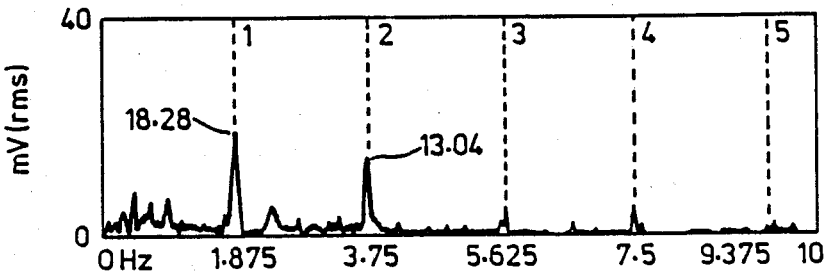
FIGS. 8*a* to 8*c* are traces similar to FIGS. 6*a* to 6*c* respectively, showing the effect of the operation of the eccentricity correction system of the invention.
Figure 8B:
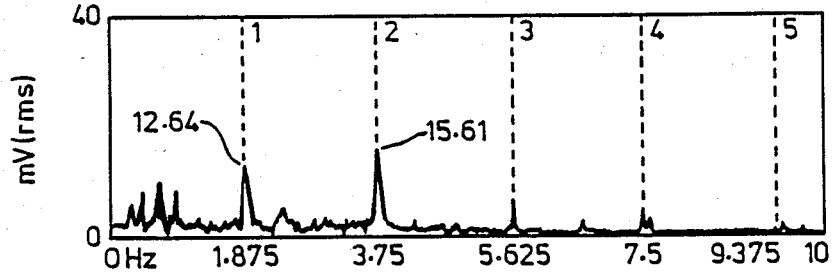
Figure 8C:
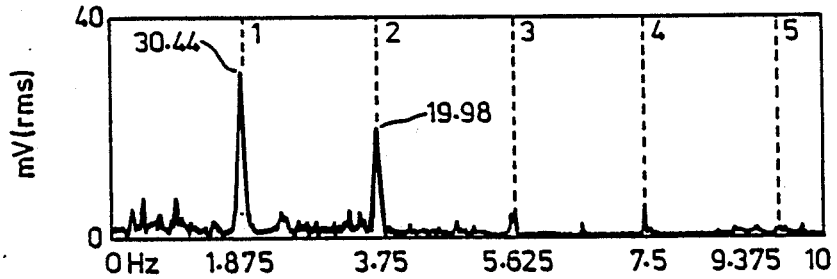

FIGS. 6*a* to 6*c* show the frequency spectrum obtained in total rolling load, FIG. 6*a* showing the overall averaged values, while FIGS. 6*b* and 6*c* respectively show the spectra obtained for the drive side load and the operator side load. Table I below shows the analysis of the total contributions of the various harmonics to the roll spectra and indicate that compensation for at least the second harmonic will introduce significant compensation, these figures being those obtained without operation of the eccentricity cancellation controller.

TABLE I

| ROLLING LOAD SPECTRUM ANALYSIS ECCENTRICITY CANCELLATION "OFF" | | |
|---|---|---|
| Frequency | | % of Total |
| TOTAL SPECTRUM | | |
| Total | | 100% |
| B/U Fundamental | (1.875 Hz) | 55% |
| B/U 2nd Harm. | (3.75 Hz) | 19% |
| B/U 3rd Harm. | (5.625 Hz) | 2% |
| B/U 4th Harm. | (7.50 Hz) | 1% |
| DRIVE SIDE SPECTRUM | | |
| Total | | 100% |
| B/U Fundamental | (1.875 Hz) | 29% |
| B/U 2nd Harm. | (3.75 Hz) | 27% |
| B/U 3rd Harm. | (5.625 Hz) | 2% |
| B/U 4th Harm. | (7.50 Hz) | 1% |
| OPERATOR SIDE SPECTRUM | | |
| Total | | 100% |
| B/U Fundamental | (1.875 Hz) | 63% |
| B/U 2nd Harm. | (3.75 Hz) | 15% |
| B/U 3rd Harm. | (5.625 Hz) | 1% |
| B/U 4th Harm. | (7.50 Hz) | 1% |

FIGS. *7a* to *7c* show the corresponding rolling load trace obtained with the cancellation controller in operation and shows a significant reduction in the peak to peak values that are obtained. Thus, in this test the back-up roll fundamental frequency amplitude was reduced by 39%, and the total load variation, which includes all frequencies, by 10%. The total load variation was not reduced by an equal amount because, as illustrated above, the back-up roll fundamental frequency is only one component, and the other component frequencies constituted by the harmonics and work roll frequencies are of the significance specified.

FIGS. *8a* and *8b* are the corresponding rolling load spectra obtained with the eccentricity cancellation control and circuit in operation, and the significant reduction in the peaks of the frequencies is clearly seen. The contribution of these frequencies is also set out in the Table II below.

TABLE II

| ROLLING LOAD SPECTRUM ANALYSIS ECCENTRICITY CANCELLATION "ON" | | |
|---|---|---|
| Frequency | | % of Total |
| TOTAL SPECTRUM | | |
| Total | | 100% |
| B/U Fundamental | (1.875 Hz) | 22% |
| B/U 2nd Harm. | (3.75 Hz) | 27% |
| B/U 3rd Harm. | (5.625 Hz) | 2% |
| B/U 4th Harm. | (7.50 Hz) | 2% |
| DRIVE SIDE SPECTRUM | | |
| Total | | 100% |
| B/U Fundamental | (1.875 Hz) | 15% |
| B/U 2nd Harm. | (3.75 Hz) | 32% |
| B/U 3rd Harm. | (5.625 Hz) | 2% |
| B/U 4th Harm. | (7.50 Hz) | 2% |
| OPERATOR SIDE SPECTRU | | |
| Total | | 100% |
| B/U Fundamental | (1.875 Hz) | 43% |
| B/U 2nd Harm. | (3.75 Hz) | 26% |
| B/U 3rd Harm. | (5.625 Hz) | 2% |
| B/U 4th Harm. | (7.50 Hz) | 1% |

Comparison of FIGS. *5b* and *5c* and FIGS. *7b* and *7c* show that with the cancellation control inoperative, the fundamental frequency load variation on the operator side of the back-up roll was more than twice as large as on the drive side, and this ratio prevailed with the eccentricity cancellation control in effect. It is also noticeable that on the drive side, and with the eccentricity controller inoperative, the second harmonic frequency was of about the same magnitude as the fundamental frequency. The phase difference between operator and drive side back-up roll fundamental frequencies is negligible in the test observed, but this must not be assumed to always be the case. The prototype system from which these curves were derived was designed only to act at the back-up roll frequency on the total load effect, and not the individual side effects as measured, so that any side to side differences and their compensations were only averaged. Improved results would therefore be expected if, instead of averaging the signals, the individual harmonic frequencies are addressed and compensated.

These graphs were obtained in rolling an aluminum coil 1,250 mm wide during a roughing pass in which its thickness was reduced from 0.94 to 0.59 mm operating at a speed of 500 m/m, the wave forms for the rolling mill spectrum being captured at the peak of the back-up roll eccentricity beat, the nominal rolling load being about 725,000 Kg.

The embodiments of the invention in which an exclusive property of privilege is claimed are defined as follows:

1. Apparatus for the detection, measurement and display of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be detected, measured and displayed;

means feeding the said pressure electric signal to a first narrow band-pass filter of band-pass characteristic such as to pass a signal variation of the frequency of the roll eccentricity;

means receiving the filtered signal from the first filter and feeding it to a second narrow band-pass filter of the same band-pass characteristic as the first filter;

means feeding the speed electric signal to the pair of said first and second band-pass filters to vary the respective filter band-pass characteristics thereof in accordance with the roll speed;

means receiving the filtered signal from the second filter and producing directly therefrom a display electric signal; and means applying the said directly-produced display electric signal to a visual display means for viewing by an operator to show the magnitude of the roll eccentricity.

2. Apparatus as claimed in claim 1, including means for controlling the phase of the filtered signal from the second filter relative to the input pressure electric signal thereto to maintain them in phase locked synchronism with one another.

3. Apparatus as claimed in claim 1, and for the detection, measurement and display of a plurality of different roll eccentricities of the rolling mill, wherein there are provided separate pairs of said first and second narrow band-pass filters for each of the eccentricities to be detected, measured and displayed; wherein said means feeding the said pressure electric signal feeds the signal to the said pairs of band-pass filters in parallel; and wherein said means receiving the filtered signals produce therefrom respective directly-produced display electric signals.

4. Apparatus as claimed in claim 1, wherein the said plurality of different roll eccentricities consists of a basic eccentricity and at least one harmonic of the basic eccentricity; wherein there are provided separate pairs of first and second narrow band-pass filters for the basic eccentricity and for a harmonic of the basic eccentricity to be detected, measured and displayed; wherein said means feeding the said pressure electric signal feeds the signal to the said pairs of band-pass filters in parallel; and wherein said means receiving the filtered signals produce therefrom respective directly-produced display electric signals.

5. Apparatus as claimed in claim 4, including means for controlling the phase of the output filtered signal from each second filter of a pair relative to the respective input signal thereto to maintain them in phase locked synchronism with one another.

6. Apparatus as claimed in claim 3, including for each second filter of a pair means for controlling the phase of the respective output filtered signal relative to the input signal thereto to maintain them in phase locked synchronism with one another.

7. Apparatus as claimed in claim 1, wherein the filtered signal from the second filter of a pair is fed to a short time constant circuit, the output of which is in turn fed to a display means displaying the track of the respective eccentricity.

8. Apparatus as claimed in claim 1, wherein the filtered signal from the second filter of a pair is fed to a long time constant circuit, the output of which is in turn fed to a display means displaying the average of the respective eccentricity.

9. Apparatus as claimed in claim 1, wherein the pressure electric signal is fed to a spike detector circuit, the output of which is in turn fed to a spike threshold and counting circuit counting the number or the rate of production of spikes of more than a predetermined magnitude.

10. Apparatus as claimed in claim 1, wherein the said pair of first and second band-pass filters has a band-pass characteristic of basic back-up roll eccentricity and produces a back-up roll filtered signal, the apparatus also comprising:

a second pair of first and second band-pass filters having a band-pass characteristic of basic work roll eccentricity and producing a work roll filtered signal;

means feeding the speed electric signal to the second pair of band-pass filters to vary the pass band characteristics thereof in accordance with the work roll speed;

a summing circuit summing the back-up roll and work roll filtered signals to give a summed signal;

circuit means providing a rolling load average electric signal;

circuit dividing means dividing the summed signal by the average signal to give a divided signal representative of the ratio of the summed signal to the rolling load average signal; and display means displaying the result of the said division and annunciating when it increases beyond a predetermined value.

11. Apparatus as claimed in claim 10, and comprising a third pair of first and second band-pass filters having a band-pass characteristic of back-up roll bearing eccentricity and producing a bearing filtered signal;

means feeding the speed electric signal to the third pair of band-pass filters to vary the pass band characteristics thereof in accordance with back-up roll speed; and wherein the bearing filtered signal is fed to the summing circuit to be summed with the back-up roll and work roll filtered signals.

12. Apparatus for the detection and correction of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be corrected;

means feeding the said pressure electric signal to a first narrow band-pass filter of band-pass characteristic such as to pass a signal variation of the frequency of the roll eccentricity;

means receiving the filtered signal from the first filter and feeding it to a second narrow band-pass filter of the same band-pass characteristic as the first filter;

means feeding the speed electric signal to the pair of said first and second band-pass filters to vary the respective filter band-pass characteristics thereof in accordance with the roll speed; and means receiving the filtered signal from the second filter, producing directly therefrom the said electric correction signal and applying it to the roll pressure varying means to at least partially correct for the roll eccentricity.

13. Apparatus as claimed in claim 12, including means for controlling the phase of the output filter signal from the second filter of the pair relative to the input signal thereto to maintain them in phase locked synchronism with one another.

14. Apparatus as claimed in claim 12, and for the detection, measurement and display of a plurality of different roll eccentricities of the rolling mill, wherein there are provided separate pairs of first and second narrow band-pass filters for each of the eccentricities to be detected and corrected; wherein said means feeding the said pressure electric signal feeds the signal to the pairs of band-pass filters in parallel; and wherein said means receiving the filtered signals produce directly therefrom respective electric correction signals.

15. Apparatus as claimed in claim 14, wherein the said plurality of different roll eccentricities consists of a basic eccentricity and at least one harmonic of the basic eccentricity; wherein there are provided separate pairs of first and second narrow band-pass filters for the basic eccentricity and for a harmonic of the basic eccentricity to be detected and corrected; wherein said means feeding the said pressure electric signal feeds the signal to the pairs of band-pass filters in parallel; and wherein said means receiving the filtered signals produce directly therefrom respective electric correction signals.

16. Apparatus as claimed in claim 15, including means for controlling the phase of the output filtered signal from each second filter of a pair relative to the respective input electric signal thereto to maintain them in phase locked synchronism with one another.

17. Apparatus as claimed in claim 14, including means for controlling the phase of the output filtered signal from each second filter of a pair relative to the respective input electric signal thereto to maintain them in phase locked synchronism with one another.

18. Apparatus as claimed in claim 12, wherein the said pair of first and second band-pass filters has a band-pass characteristic of basic back-up roll eccentricity and produces a back-up roll filtered signal, the apparatus also comprising:

a second pair of first and second band-pass filters having a band-pass characteristic of basic work roll eccentricity and producing a work roll filtered signal;

means feeding the speed electric signal to the second pair of band-pass filters to vary the pass band characteristics thereof in accordance with the work roll speed;

a summing circuit summing the back-up roll and work roll filtered signals to give a summed signal; and means producing directly from the summed signal a summed correction signal and applying it to the roll pressure varying means.

19. Apparatus as claimed in claim 18, and comprising a third pair of first and second band-pass filters having a band-pass characteristic of back-up roll bearing eccentricity and producing a bearing filtered signal;

means feeding the speed electric signal to the third pair of band-pass filters to vary the pass band characteristics thereof in accordance with back-up roll speed; and wherein the bearing filtered signal is fed to the summing circuit to be summed with the back-up roll and work roll filtered signals.

20. Apparatus as claimed in claim 1, wherein the said filtered electric signal from the second filter of a pair of first and second filters is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricity; and means feeding the said signal R/S.T to a display means for display of a representation thereof.

21. Apparatus as claimed in claim 10, wherein the said summed signal is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricities; and means feeding the said signal R/S.T to a display means for display of a representation thereof.

22. Apparatus as claimed in claim 12, wherein the said filtered electric signal from the second filter of a pair of first and second filters is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricity; and means feeding the said signal R/S.T to a display means for display of a representation thereof.

23. Apparatus as claimed in claim 18, wherein the said summed signal is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricities; and means feeding the said signal R/S.T to a display means for display of a representation thereof.

24. Apparatus for the detection, measurement and display of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be detected, measured and displayed;

means feeding the said pressure electric signal to a first narrow band-pass filter of band-pass characteristic of basic back-up roll eccentricity such as to pass a signal variation of the frequency of the basic back-up roll eccentricity and to a second narrow band-pass filter of band-pass characteristic of basic work roll eccentricity such as to pass a signal variation of the frequency of the work roll eccentricity;

means feeding the speed electric signal to the first and second band-pass filters to vary the respective filter band-pass characteristic in accordance with the respective roll speed;

means receiving the filtered signals and producing directly therefrom a respective display electric signal;

means applying the said directly-produced display electric signals to respective visual display means for viewing by an operator to show the magnitude of the roll eccentricity;

a summing circuit summing the back-up roll and work roll filtered signals to give a summed signal;

circuit means providing a rolling load average electric signal;

circuit dividing means dividing the summed signal by the average signal to give a divided signal representative of the ratio of the summed signal to the rolling load average signal; and display means displaying the result of the said division and annunciating when it increases beyond a predetermined value.

25. Apparatus as claimed in claim 24, and comprising a third band-pass filter having a band-pass characteristic of back-up roll bearing eccentricity and producing a bearing filtered signal;

means feeding the speed electric signal to the third band-pass filter to vary the pass band characteristic in accordance with back-up roll speed; and wherein the bearing filtered signal is fed to the summing circuit to be summed with the back-up roll and work roll filtered signals.

26. Apparatus as claimed in claim 24, wherein the said summed signal is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricities; and means feeding the said signal R/S.T to a display means for display of a representation thereof.

27. Apparatus for the detection and correction of roll eccentricity in a rolling mill comprising:

means for producing a pressure electric signal representative of the on-going magnitude of the rolling pressure applied between the work rolls;

means for varying the rolling pressure in accordance with an electric correction signal applied thereto;

means for producing a speed electric signal representative at least approximately of the speed of rotation of the roll whose eccentricity is to be corrected;

means feeding the said pressure electric signal to a first narrow band-pass filter of band-pass characteristic of basic back-up roll eccentricity such as to pass a signal variation of the frequency of the basic back-up roll eccentricity and to a second narrow band-pass filter of band-pass characteristic of basic work roll eccentricity such as to pass a signal variation of the frequency of the work roll eccentricity;

means feeding the speed electric signal to the first and second band-pass filters to vary the respective filter band-pass characteristic in accordance with the respective roll speed;

a summing circuit summing the back-up roll and work roll filtered signals from the first and second filters to give a summed signal; and means producing directly from the summed signal a summed correction signal and applying it to the roll pressure varying means to at least partially correct for the respective roll eccentricities.

28. Apparatus as claimed in claim 27, and comprising a third band-pass filter having a band-pass characteristic of back-up roll bearing eccentricity and producing a bearing filtered signal;

means feeding the speed electric signal to the third band-pass filter to vary the pass band characteristic in accordance with back-up roll speed; and wherein the bearing filtered signal is fed to the summing circuit to be summed with the back-up roll and work roll filtered signals.

29. Apparatus as claimed in claim 27, wherein the said summed signal is fed as a signal R to a ratio circuit;

the apparatus including a long time constant load averaging circuit providing a respective load averaging signal;

a register circuit containing information as to the modulus of the strip being rolled and fed with the said load averaging signal to produce a corresponding output signal S;

means producing a strip exit gauge signal T;

means feeding the signals S and T to the ratio circuit to obtain an output signal R/S.T representing gauge duration as a percentage of the nominal gauge due to the respective eccentricities; and means feeding the said signal R/S.T to a display means for display of a representation thereof.

* * * * *